US005097886A

United States Patent [19]

Moyet-Ortiz

[11] Patent Number: 5,097,886

[45] Date of Patent: Mar. 24, 1992

[54] ENVIRONMENTAL BARRIER

[76] Inventor: Francisco Moyet-Ortiz, Valle Tolimas, Calle 11 N-17, Caguas, P.R. 00625

[21] Appl. No.: 561,146

[22] Filed: Aug. 1, 1990

[51] Int. Cl.[5] ..... E06B 9/00

[52] U.S. Cl. ..... 160/368.1; 160/392

[58] Field of Search ..... 160/354, 368.1, 392; 24/57

[56] References Cited

U.S. PATENT DOCUMENTS 2,246,663 6/1941 Bradshaw ..... 160/354
2,886,481 5/1959 Swan ..... 160/354 X
3,255,810 6/1966 Rowbottam ..... 160/354
4,249,589 2/1981 Loeb ..... 160/354 X

*Primary Examiner*—Carl D. Friedman
*Assistant Examiner*—Derek J. Berger
*Attorney, Agent, or Firm*—William Nitkin

[57] ABSTRACT

An environmental barrier having a flexible panel member such as a screen panel for easy cleaning, said barrier attached to a window frame and having insert members on opposite sides of the panel member which are positioned in insert receipt channel members positioned on the window frame with resilient strips on the panel members being compressed and sealing the other edges of the panel member which is held in place by catch members and a window utilizing such panel member.

11 Claims, 4 Drawing Sheets

ENVIRONMENTAL BARRIER

BACKGROUND OF THE INVENTION

1. Field of the Invention

The structure of this invention resides in the area of environmental barriers such as windows and window screens and more particularly relates to an easily removable, flexible screen with an improved system of screen retention over a window frame.

2. Description of the Prior Art

Window screens are well known in the prior art to prevent insects from entering screened-in areas. Existing window screens often are made of a metal or plastic mesh held within a framework which moves within channels which are part of the window frame. Window screens are notoriously fragile and need to be very carefully handled when they are removed for cleaning from their rigidly held position within such window frames. The usual method of cleaning screens is hosing them down and brushing them on a flat surface on which the screen rests while being scrubbed. The cleaning of screens is a difficult and onerous task, and it has been appreciated in the past that screens not having the rigidity of frames have some advantages as far as cleaning as will be described further below. One such structure is disclosed in U.S. Pat. No. 4,249,589 to Loeb which basically provides for a flexible screen material with hook and loops fastener material strips along its sides and mating velcro along the window frame to which the screen is attached. A problem with such a structure occurs when the screen is washed as the hook and loop material itself along the edges has a tendency to become clogged with other materials and is itself very difficult to clean. Another patent of interest is U.S. Pat. No. 2,886,481 to Swan which discloses a screen forming a spline element at the edges thereof.

SUMMARY OF THE INVENTION

It is an object of this invention to provide an improved flexible screen which screen can be easily removed for washing in a washing machine and thereafter quickly reinstalled. It also should be noted that instead of a traditional screen mesh element, any flexible environmental controlling barrier can be utilized in this invention such as a clear plastic sheet and the like, to form what are commonly known as storm windows over the windows of a structure and storm doors.

It is a further object of this invention to provide an auxiliary structure for installation on existing window frames having channel members which will retain the flexible screen members of this invention securely in place. Alternatively, the structure of this invention can be formed as part of new window construction where the channels used in this invention are formed as part of the window and/or frame as an incorporated member.

It is a still further object of this invention is to provide a panel screen structure to be used to display designs such as Christmas season designs or other designs, colors and the like to be used for environmental purposes.

The screen or other environmental control barrier which forms the flexible panels of this invention to be installed over a window can be washed in a washing machine which capability is felt to be highly desirable. The openings that can be encompassed by the structure of this invention not only can be rectangular, but also can be of any desired shape such as round or odd-shaped to accommodate air conditioners, for example.

Thus even though the structure of this invention may be illustrated as being of the conventional rectangular shape, it should be noted throughout that other panel shapes can be incorporated with the structure of this invention.

The invention includes, with reference to a rectangular window, a pair of channel members spaced apart from one another on opposite sides of the frame and insert members each affixed to opposite sides of the screen panel which insert members are adapted to be inserted/snapped and retained within the channels so that the two opposite sides of the screen panel are held securely when the insert members are slid/snapped into position in the channels. The other two sides of the screen panel, if left unattended, would be open to the environment to allow entry of undesired insects, foreign material such as dust, and the like. On these sides first at the four corners are fastening members such as small patches of hook and loop fastener material with mating hook and loop fastener material on the window frames just beyond the ends of the channels so that the screen panel can be held in place. Resilient, compressible strips of material such as foam members are attached under the open side edges of the screen panel extending between the fastening members to act as a seal when compressed against the window frame. In some instances when more rigidity is needed, a system of snap-type fasteners can be used along the open side edges. When one wishes to remove the screen panel from the window structure, one peels open the hook and loop fastener material corner members or unsnaps the fasteners and slides the screen panel upwards or downwards, pulling or snapping out the two insert members from the channels until the screen panel is released from the window. The insert members, being made of a flexible plastic or equivalent material, allow the screen panel to be placed in a washing machine for cleaning. Other types of retention means can be used as will be described further below.

DESCRIPTION OF THE PREFERRED EMBODIMENT(S)

Figure 1:
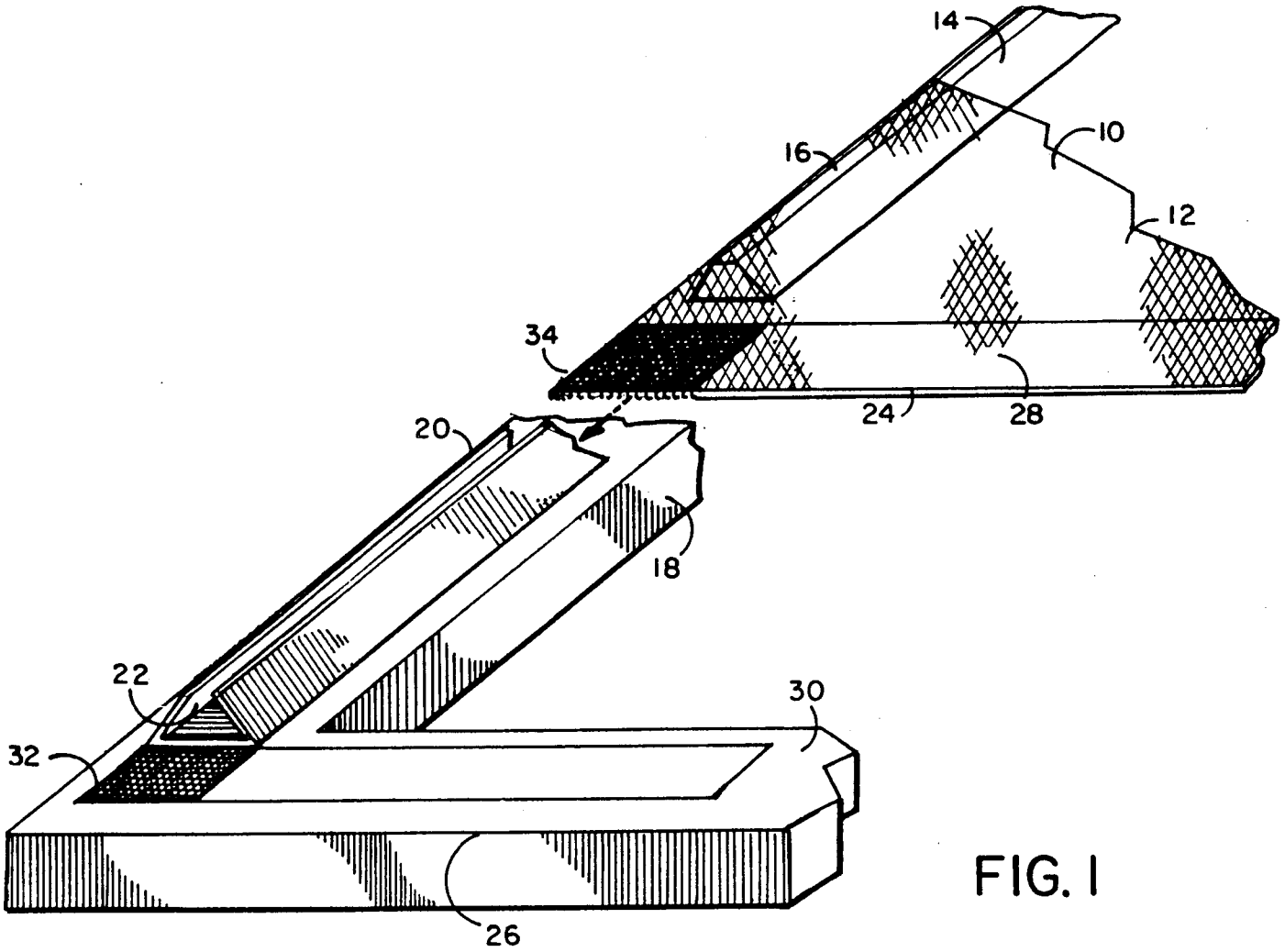
FIG. 1 illustrates a perspective view of a corner of a window frame of the device of this invention showing the channel, screen panel and insert.
Figure 2:
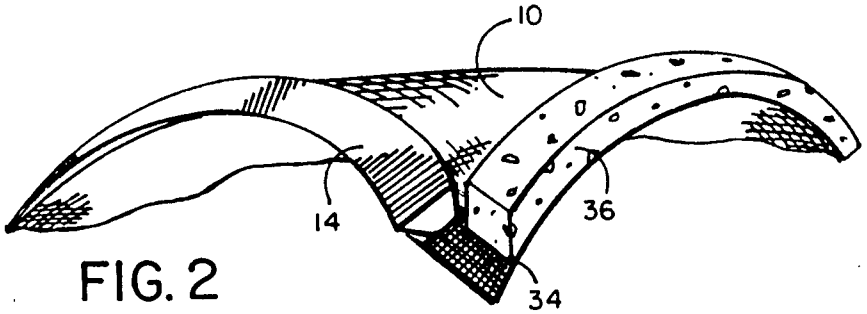
FIG. 2 illustrates a perspective view of a screen panel bent rearwards to reveal the insert member, the foam member and a hook and loop fastener material attachment member.

FIG. 1 illustrates panel 10 of this invention which, as mentioned above, can be of a screen mesh material or of a solid, flexible plastic such as a clear plastic or an equivalent environmental barrier. The embodiment illustrated is a window screen having mesh 12. Along the sides of panel 10, as seen on one side, is a flexible insert member 14 with panel 10 affixed to narrow end 16 of the top of insert member 14. A corner of window frame 18 is shown in sectional form with channel member 20 attached thereto which is seen having a triangular configuration 22. It should be noted that other retentive configurations for the channels could be used such as a circular channel with an opening. Within this channel, as can be seen by the arrow, is slid insert member 14 and securely retained because its triangular shape generally fits within the triangular-shaped opening 22 of channel member 20. When the end of screen 24 has come to the end of window frame 26, there is a portion of panel 28 which extends beyond channel member 20, and under this portion of the panel is disposed a foam member extending along the length of each of the ends. This foam, which is a resilient, compressible material, when held against window frame portion 30 by panel 10 which compresses it, seals the ends of the panel to the window frame, such ends not using channels. In order to retain panel 10 in place in the embodiments shown in FIGS. 1 and 2, a hook and loop fastener material patch 32 is utilized at each corner of the frame which mates with the mating hook or loop portion 34 on the panel so that when pushed in place, the panel at its corners is retained securely but is releasable upon lifting the hook and loop fastener material. When the hook and loop fastener material is mated, foam 36, as seen in FIG. 2, is compressed against window frame portions 30. Of course, the same structure is on each corner of the window frame so that the panel is securely retained in place.

Figure 3:
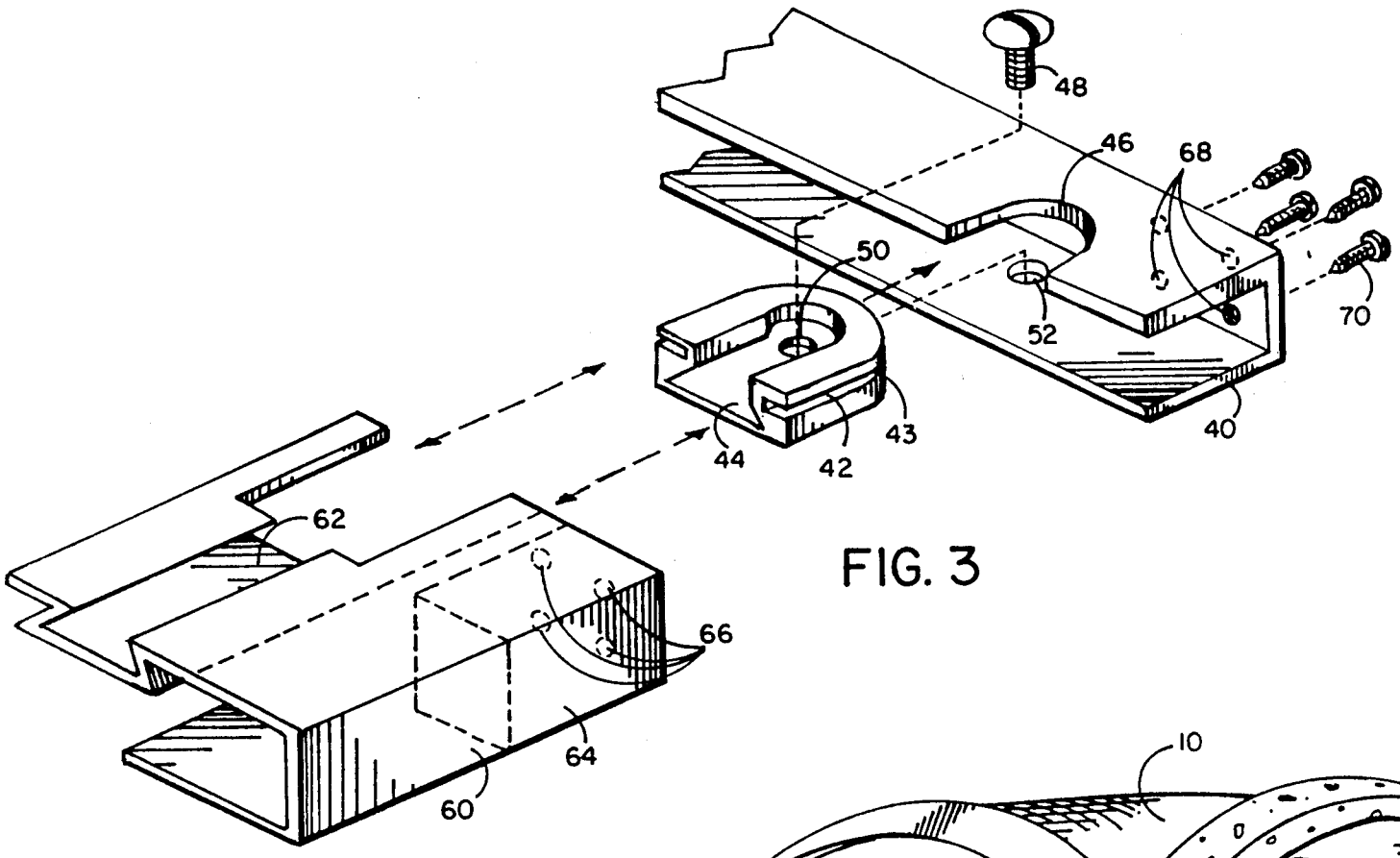
FIG. 3 illustrates an alternate corner attachment member.
Figure 3A:
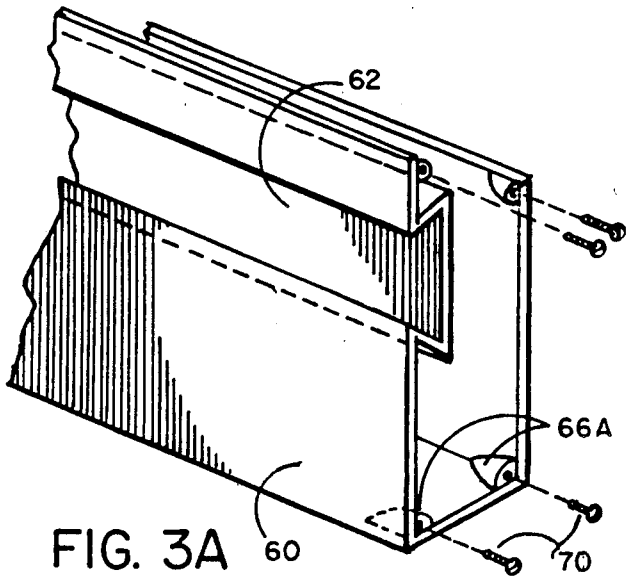
FIG. 3*a* illustrates an alternate embodiment of the structure of FIG. 3.

Other types of attachment at the corners can be utilized. As mentioned in the prior art portion of this application, hook and loop fastener material has a tendency to clog which tendency is why, in the embodiment illustrated above, only small pieces are utilized. In other embodiments special clips can be utilized such as seen in FIG. 3. In FIG. 3 the insert receipt channel, not seen, can be used in conjunction with corner attachment channel members 40 placed at the sides of the window frame which carry no insert receipt channel member thereon so that when insert member 14 is slid down through the channel of the insert receipt channel member, corner catch member 42 is utilized into which insert member 14 can then slide and be retained within triangular-shaped aperture 44. As noted above, apertures of other shapes can be utilized within window insert member 14. Corner attachment channel member 40 can have cutout portion 46 adapted to receive insert member 42 therein with slot 43 passing around cutout portion 46, and screw member 48 can be passed through first aperture 50 into and through a second aperture 52 in channel member 40 and screwed into the window frame thereunder to retain catch member 42 in place. In order to remove the panel from the window frame, one would pull insert member 14 out of aperture 44 in catch member 42 and then slide the insert member out of channel member 20. FIG. 3 further shows that side frame 60 can be attached to channel member 40 after catch member 42 is inserted within cutout portion 46 of channel member 40. Side frame 60 includes an element 64 bearing a plurality of apertures 66 for receipt of a plurality of screw members such as screw member 70 through apertures 68. FIG. 3*a* illustrates an alternate embodiment of side frame 60 wherein apertures 66*a* for receipt of screws 70 are molded integrally into frame 60 so that an element 64 shown in FIG. 3 is not needed. Channel 62 within side frame 60 aligns with the triangular-shaped aperture 44 in catch member 42 so that the insert member can be positioned therein. In this way a framework for secure attachment of the screen inserts can be provided.

Figure 4:
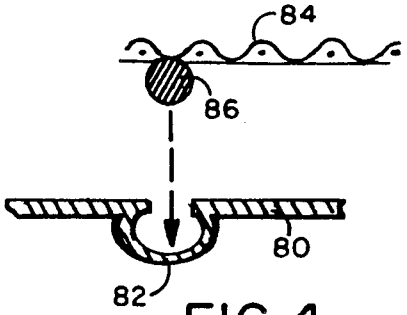
FIG. 4 illustrates a cross-sectional view through an alternate-shaped insertion member and mating channel.

FIG. 4 illustrates an alternate embodiment of the screen panel wherein channel member 80 has a semi-circular receipt area 82 into which the generally circular insert member 86 affixed to the bottom of screen member 84 can be either slid or snapped as the insert member 86 can be of resilient material to snap within channel 80 and retained therein by the upper edges of channel 80.

Figure 5:
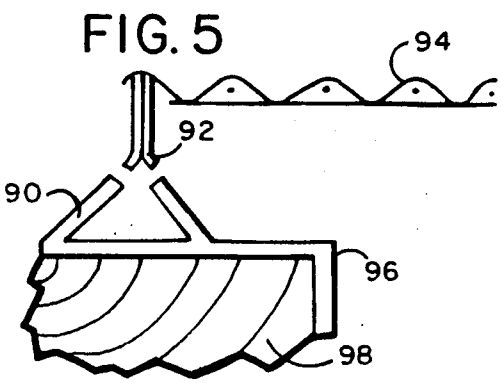
FIG. 5 illustrates a channel into which the insertion member is squeezed together and is resilient to expand within the channel to conform to the shape of the channel along with an alignment member for aligning the channel to the edge of the frame.

FIG. 5 illustrates a further alternate embodiment with a cross-sectional view through a channel 90 which is generally triangular in shape wherein the insert member is not slid therein but snapped. The insert member is shown in a compressed form with insert member 92 being of resilient material such as a stiff foam or the like which, when released after being positioned within channel 90, expands therein to fill the area of channel 90 to retain screen 94 in place. Also seen in this view is an extension 96 of channel 90 which extends around the edge of frame member 98 which helps to position channel 90 on the frame of the window to align it properly when it is being attached to the window frame.

Figure 6:
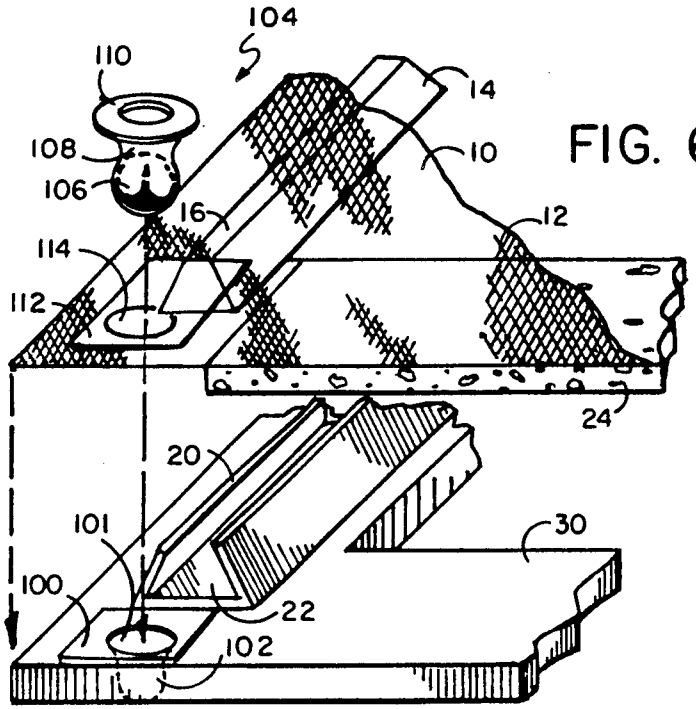
FIG. 6 illustrates an alternate structure for fastening the screen panel to a frame utilizing snap members.

FIG. 6 shows an alternate embodiment of a corner attachment means where instead of a hook and loop fastener material member being used, a series of corner snaps are utilized. Plate member 100 is positioned at the end of channel 20 with an aperture 102 formed in frame 30 below aperture 101. Aperture 101 in plate member 100 is of a size to receive snap member 104 which has a wider portion 106 which is adapted to pass through aperture 101 under pressure so that plate member 101 then will retain snap member 104 around narrower portion 108 of snap member 104. The flared-out top portion 110 of the snap member retains the corner portion 112 of screen member 12 when snap member 104 is passed through aperture 114 defined in corner portion 112 of screen member 12. The structure is installed when aperture 114 in screen member 12 is aligned over aperture 101 in plate 100 and snap 104 is inserted through both apertures from above and then snap 104 retains screen member 12 in place until snap member 104 is later removed when desired.

Figure 7:
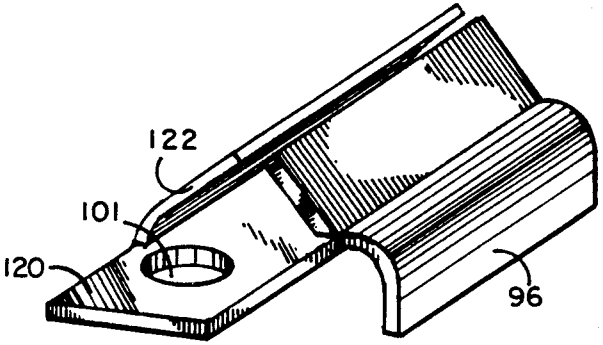
FIG. 7 illustrates the snap member fastening system of FIG. 6 with the snap receipt aperture formed within part of the channel framework.

FIG. 7 illustrates an alternate embodiment of a framework incorporating an extension 120 bearing aperture 101 therein above window frame 30 which also has an aperture 102 defined therein for receipt of snap member 104 as described above. This channel member also shows side extension member 96 as described above in relation to FIG. 5.

Figure 8:
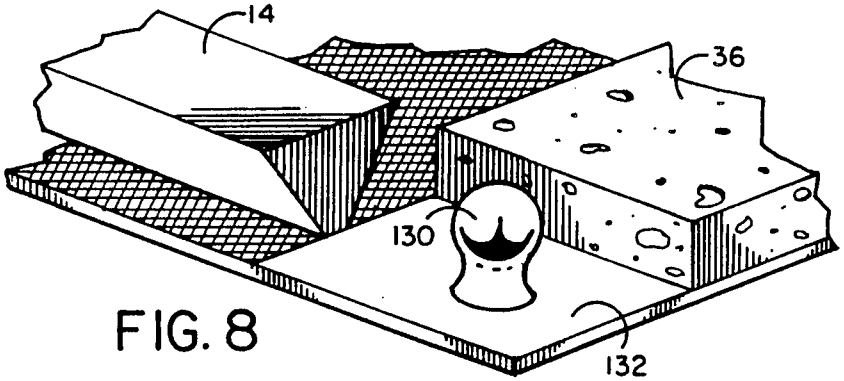
FIG. 8 illustrates a snap member positioned on the screen panel at a junction between the insert member and the resilient foam member.

FIG. 8 illustrates an embodiment where the snap member is formed as a portion of screen member 12. Seen in this view from the bottom at a junction of the insert member 14 and resilient, compressible foam member 36 is plate 132 upon which is securely mounted snap projection member 130 which can be entered into aperture 101 as described above in the embodiments of FIGS. 6 or 7 wherein the snap projection member is not an independent member as described in the above embodiments but is affixed as a portion of the screen member. It should be noted that when windows are originally manufactured, they can be made having snap receipt apertures defined at their corners to receive the snap projection members so as to be formed as part of an integral window structure that is formed and designed to utilize the structure of this invention.

Figure 9:
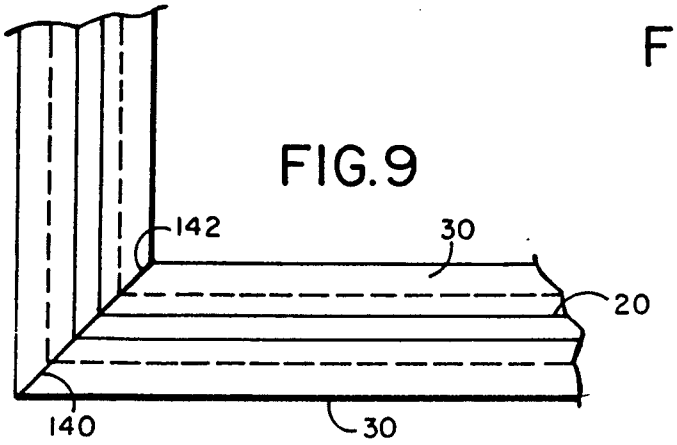
FIG. 9 illustrates a corner of a window frame where the channel members meet at a 45 degree angle for positioning therein of the insert members on the screen panel.

FIG. 9 illustrates a further structural embodiment wherein channel members 20 contained within frame 30 can be positioned so as to be located on the side of each of the frame members and meet such as at corner 140 wherein all the corners could be alike and cut, for example, at 45 degrees as seen by line 142 so as to receive insertion members positioned on all sides of the environmental panel of this invention.

Although the present invention has been described with reference to particular embodiments, it will be apparent to those skilled in the art that variations and modifications can be substituted therefor without departing from the principles and spirit of the invention.

I claim:

1. An environmental barrier in combination with a window frame comprising:

a rectangular flexible panel member having first, second, third and fourth sides, said first side being opposite said third side, and said second side being opposite said fourth side and a front face and a rear face;

a pair of flexible, compressible insert members, each triangular in cross-section, each disposed extending along opposite first and third sides of said panel member on said rear face, each of said insert members attached to said panel member along one of the points of their triangular shape;

a pair of flexible compressible foam resilient members, each respectively disposed extending along the opposite second and fourth sides of said panel on said rear face from said insert members;

catch members each disposed at the junction of each of said insert members and said resilient members on said rear face; and at least two insert receipt channel members triangular in cross-section disposed on the sides of said window frame adapted to receive and removably retain said insert members on said panel member, said insert members positioned each within an insert receipt channel member, each of said catch members attached to said window frame at a position adjacent to each of said insert receipt channel members with said foam resilient members being held and compressed against said window frame by said second and fourth sides of said panel member to form an environmental barrier structure.

2. The structure of claim 1 wherein said catch members are snap fasteners.

3. The structure of claim 2 further including:

an aperture defined in each of said catch members;

a plurality of projection snap members for insertion through said apertures in said catch members; and a plurality of receipt apertures each defined in each of said portions of said window frame beneath said catch members to receive said projection snap members when passed through the apertures in said catch members to retain said panel member to said window frame.

4. The structure of claim 3 wherein said projection snap member is an independent projection member and said panel member has an aperture defined therein for receipt therethrough of said independent projection member for engagement of the independent projection member into the aperture formed in the window frame structure.

5. The structure of claim 2 wherein said window frame includes catch receipt members integrally formed therein and said panel member has projection members positioned thereon adapted to be received in said catch members in said window frame.

6. The structure of claim 5 wherein said projection members are integrally formed as part of the panel members at the junction between said resilient members and said insert members.

7. The structure of claim 1 wherein said catch members are mating pieces of hook and loop fastener, one piece positioned on said window frame and the other piece positioned on said panel member.

8. The structure of claim 1 wherein each of said catch members has a channel defined therein adapted to receive a portion of one of said insert members of said panel member; and means to retain said catch members to said window frame structure.

9. The structure of claim 1 wherein said insert members disposed on said panel member are slid into said insert receipt channel members.

10. The structure of claim 1 wherein said insert members are snapped into said insert receipt channel members.

11. The structure of claim 1 wherein said insert receipt channel member has a laterally extending projection incorporated therewith with a projection at the end thereof adapted to catch on the edge of said window frame, said extending projection forming an aligning edge, said aligning edge providing a quick and easy method of aligning said insert receipt channel to said window frame.

* * * * *